United States Patent [19]

Dubner

[11] Patent Number: 4,744,157

[45] Date of Patent: May 17, 1988

[54] CUSTOM MOLDING OF FOOTGEAR

[76] Inventor: Benjamin B. Dubner, 84 Marcus Ave., New Hyde Park, N.Y. 11040

[21] Appl. No.: 915,669

[22] Filed: Oct. 3, 1986

[51] Int. Cl.[4] ..... A43B 7/14; A43B 13/38

[52] U.S. Cl. ..... 36/88; 36/44; 36/71; 36/93; 36/119; 128/594

[58] Field of Search ..... 36/93, 88, 71, 119, 36/43, 44; 128/594, 595

[56] References Cited

U.S. PATENT DOCUMENTS

| | | | |
|---|---|---|---|
| 2,365,807 | 12/1944 | Dialynas | 128/594 |
| 3,121,430 | 2/1964 | O'Reilly | 128/595 |
| 4,662,087 | 5/1987 | Beuck | 36/88 |

FOREIGN PATENT DOCUMENTS

| | | | |
|---|---|---|---|
| 200963 | 12/1958 | Austria | 128/594 |
| 2308547 | 8/1974 | Fed. Rep. of Germany | 36/71 |
| 2456754 | 6/1975 | Fed. Rep. of Germany | 36/93 |
| 2926246 | 1/1981 | Fed. Rep. of Germany | 36/43 |
| 3344119 | 6/1985 | Fed. Rep. of Germany | 36/43 |

*Primary Examiner*—James Kee Chi

[57] ABSTRACT

An apparatus for molding the soles and uppers of various types of footgear to the contours of individual feet, said apparatus comprising multiple, individual, complete elements, each of said elements comprising impervious structure for receiving, maintaining, retaining and withdrawal of molding material; said structure defining an end port piece with valve-like action to maintain closure while permitting selective insertion and withdrawal of molding material; a flexible bag to receive and contain said molding material; a connecting part between said end port piece and said flexible bag, where said connecting part is a flat tube-like structure of unique construction, said unique construction permitting passage and retention of molding material without any readily apparant increase in cross section; where the number of said elements employed varies with the type of footgear; and where the shape and size of each element varies with its location in said footgear, and where said shape and size of each of said connecting parts varies to permit the location of end port pieces in any desirable part of the footgear; and where said molding material is of a non-setting matter such as water or air.

7 Claims, 5 Drawing Sheets

15
20
71
2
2
73
70
63
30
50
15F
15D
15E
11
15C
10
20C
15B
20B
30B
30C
30E
30D
30A
20F
30F
30G
20G
15G
20E
20D
20A
15A
70
73
71

Fig. 7.
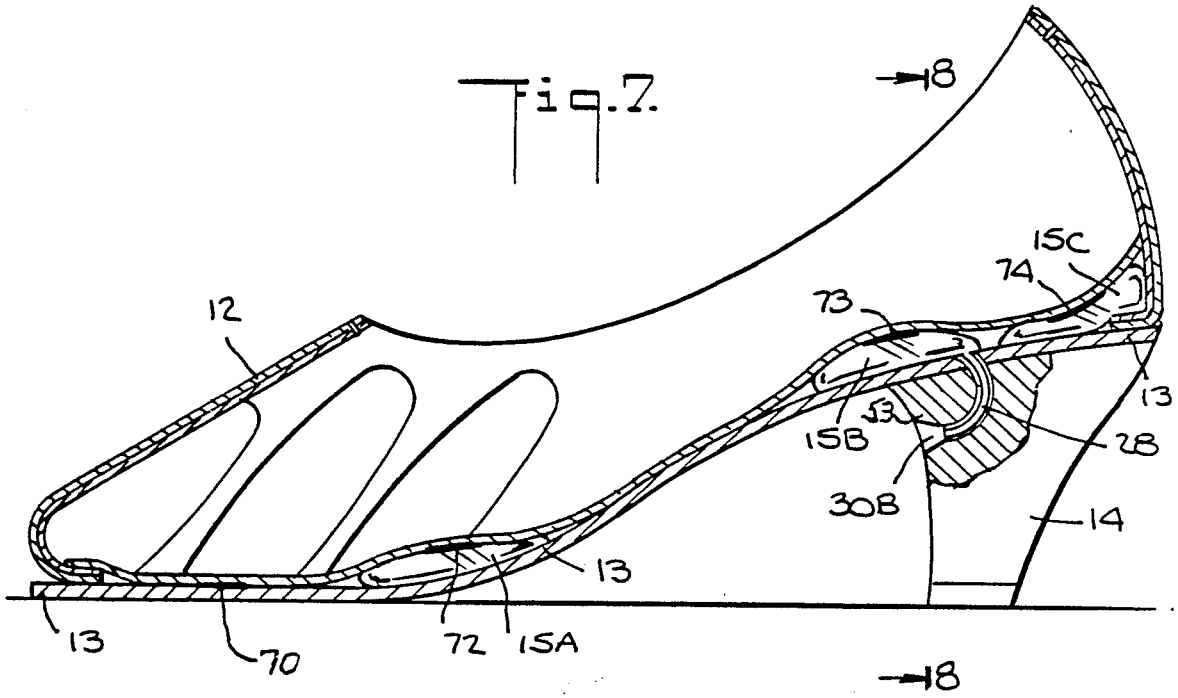
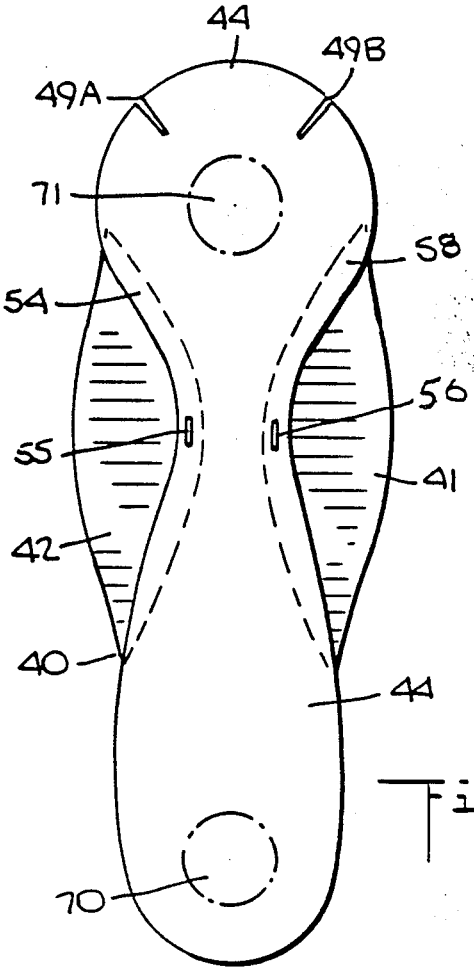
Fig. 15.
Fig. 8.
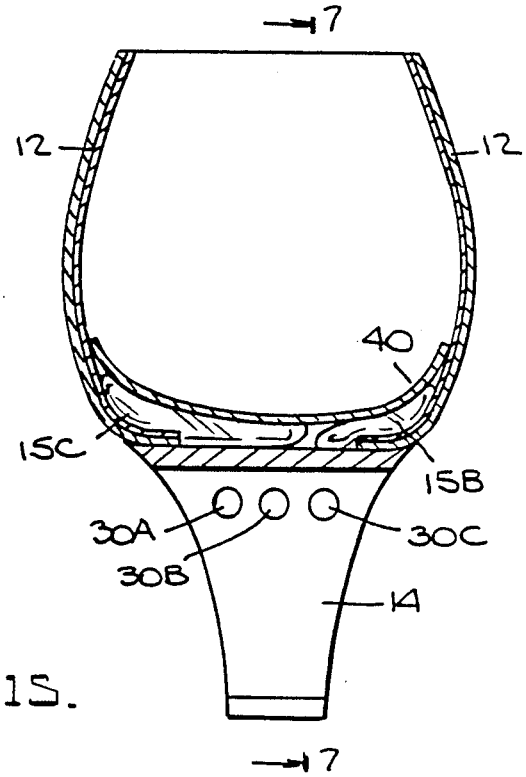

Fig. 12.
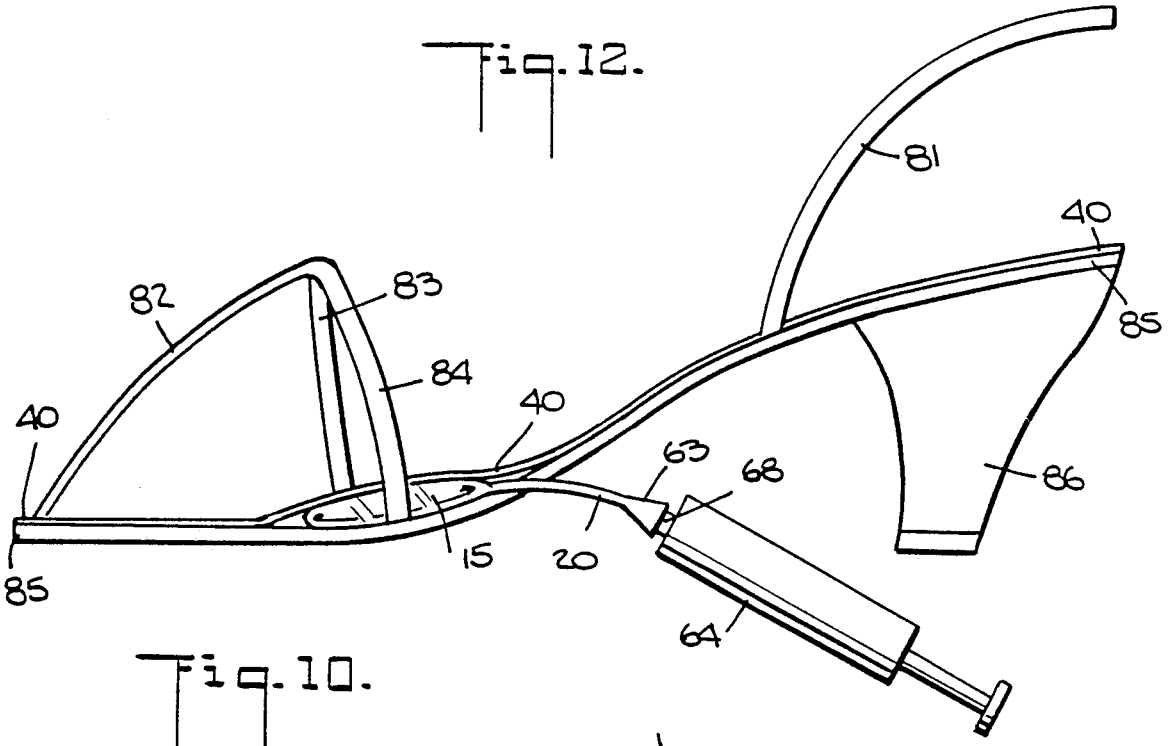
Fig. 10.
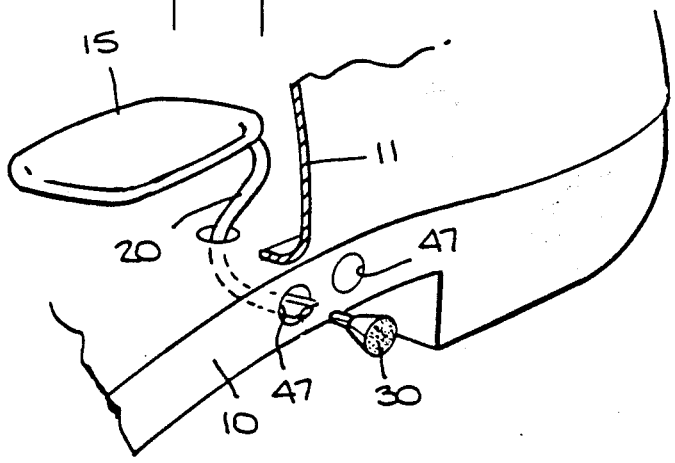
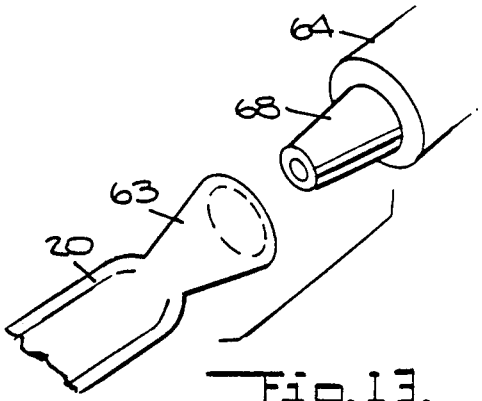
Fig. 13.
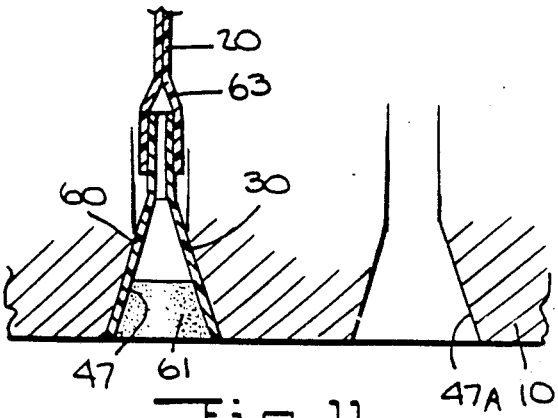
Fig. 11
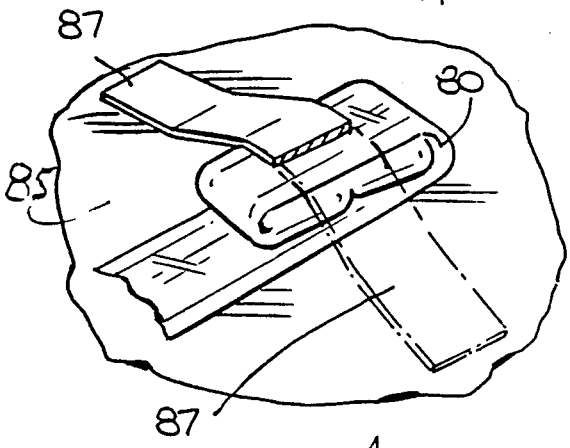
Fig. 14.

CUSTOM MOLDING OF FOOTGEAR

BACKGROUND OF THE INVENTION

The invention relates generally to the field of custom fitted footgear: dress shoes, athletic boots, sneakers, running shoes, orthopedic shoes, and the like, and more particularly to an improved means for accomplishing same.

Modern living demands walking and running on unnatural hard, flat surfaces in footgear manufactured on lasts contoured to a non-existant "average foot", said lasts being further distorted by considerations of style.

Because of the many variables in the shape and contours of feet, as well as footgear, of the same size, it has been estimated that approximately 70% of people are fitted poorly and that often the entire weight is supported on two small areas of the foot. This causes an unbalanced, unsteady gait which often results in tired and painful feet and legs as well as other discomforts and deformities that can extend up through the back and the entire body.

It is known in the art to control postural problems of the individual foot by various means worn inside footgear. However, each of said means has its own advantage and disadvantage.

Doctors of Podiatry, among others, make effective rigid and simi-rigid "Foot Orthotics" over positive Plaster of Paris casts of a patient's foot, said cast being taken in a neutral attitude. This is a lengthy and costly process, requiring the services of highly trained personnel to take the casts and laboratories to fabricate the Orthotic, after which adjustments have to be made to ccmpensate for dynamic problems which the static cast cannot duplicate. Further, a hard cast cannot properly reproduce the differences between thin-skinned and fat feet which influences the result. The process takes several weeks to complete. Further, Orthotics cannot be worn in all footgear, and especially not in most ladies dress shoes.

To overcome the necessity of trained personnel and an involved and expensive process, various other methods of achieving foot balance and the distribution weight and support are known in the art. One is the well known "arch support" which is made of leather and foam, or leather and spring steel sections, and the like. These are offered in shoe sizes, with high, low, and medium differences in height. They have the advantage of being fitted "off the shelf".

Other means of changing the inner contours of footgear involve molding the interior of the footgear to permanently reflect the shape of the individual foot. This is achieved by placing an envelope containing a mix of molding material into the footgear, or by injecting same, said molding material quickly setting or hardening.

These and other methods achieve relatively small benefits because they are based on the erroneous popular belief that foot and body comfort can the achieved by supporting the medial long arch of the foot. Visually and anatomically, this is obviously false. Visual inspection of a wet foot print will show that the foot makes ground contact only at the heel and ball area. In some cases, there may be some contact along the lateral border of the foot. The "arch" of the foot not making contact is made up of several Tarsal bones, which are squarish in configuration, and very rough for ligamentous attachments. Pressures under this area are uncomfortable or painful.

Most "supports", whether pre-made or molded, can only be worn because they are not high enough to support the arch area. If they reach the arch area, they can only be worn after they are "broken-in", which in reality means when the shank of the footgear underlying this area has been broken down.

Further, a larger size of footgear is required to accept such "support", and most dress shoes, especially ladies', cannot accept them in any way.

Further, any method of injecting molding material requires the use of some bag-like device to contain the molding material, said bag-like device is usually connected directly to the opening means for the injection of said molding material, thus limiting choice of area for said bags and said opening. The disadvantages of other means of placing said bags and said openings apart are discussed further on.

Further, because of the many variables in feet and footgear of the same size, often only one part of the foot may benefit from said supports.

Any benefits from the use of such means are due to the incidental haphazard support at the front and back areas of the means, namely the medial and lateral areas just distal (forward) of the dependent part of the heel bone, and the area just proximal (behind) to the heads of the Metatarsal bones. The bones in these areas are smooth enough to accept pressure and thus distribute the body weight over a larger area. Further benefit occurs because these areas are over parts of the footgear, the heel and sole, that are in direct contact with the ground so that there will be no breakdown of the footgear to cause loss of supportive action.

To retain and improve upon the above benefits, while eliminating the disadvantages, attempts have been made to control separate areas of the footgear individually.

The present, inventor has contributed to the art of molding individual areas of footgear with several U.S. Patents namely U.S. Pat. No. 3,903,621, 3,736,673 and particularly 3,444,586,which teach the use of multiple individual elements located in pertinent areas of footgear, each of said elements comprising a flexible bag and a connecting tube connecting said bag to an end piece. Said end pieces are constructed to engage the unique nozzle of an injecting gun, said gun having a rotating nozzle to inject a mix of molding material into each element in turn, and, by continuing to rotate, to close off the individual end piece while the molding material sets.

While this method and others were an improvement in that they were designed to mold several individual areas of the footgear, they also had several decided disadvantages.

As with all molding materials intended to "set" within a prescribed time, the reaction is set in motion by the mixing of two or more ingredients. Various factors, such as improper mixing, change in reaction time due to shelf life, etc., often resulted in uncertain setting times. If the time was too fast, the resulting mix might not flow easily through the connecting tubes. If the time was too slow, the mold could be walked on too soon and thus be depressed and not achieve its supportive effect.

Further, if too much molding material was injected into the bags, it was not possible to withdraw the overage. Further, the foot had to be at rest to receive the molding material after which it had to set before it could be tested dynamically by walking or running. At that time, if too much or too little of the material had been injected, it was not possible to correct the situation.

Further, such a molding mix had a viscosity that required that the connecting tube between the injections gun and the retaining bag be of such size that a foot fitted over them would be painfully aware of said connecting tube. Therefore, grooves must be cut out of the sole of the footgear to receive them. This required that this method of individual molding must be manufactured into the footgear, with all its resulting problems of design, marketing, financing, etc.

Further, because of its size, the connnecting area for the end pieces of the elements and the nozzle of the injection gun could only be located in the shank area of the sole of the footgear. This interferred with the construction of this important area of footgear.

Further, fabrication of said injection gun was complicated and expensive, and cleaning of said gun between usages difficult and time consuming.

Further, as with all molding methods, the positioning of the leg and thigh was crucial to a proper molding. Control of the extremities was difficult because of the shank location of said gun and end part pieces.

Further, if at a later time the foot changed, it was not possible to make any changes in the "set" mold.

It is, therefore, among the principle assets of the present invention to provide an improved means for molding footgear for the individual foot, in which the abovementioned disadvantges and difficulties have been substantially eliminated.

Another object of the invention lies in the provision of means for molding the important areas of footgear to an individual foot, both statically and dynamically, within a few minutes, said means being such that it can be used by any shoe clerk, or even the wearer himself, in a quick, neat, clean and inexpensive manner, which means also permit the correction of mistakes.

Another object of the invention lies in the provision for the use of a molding material that will not set, and, therefore, will not require any mixing of ingredients, such non-setting material making possible the easy addition or withdrawal of molding material to insure proper fit at any time.

Another object of the invention lies in the provision of means that would easily permit its addition to already manufactured footgear.

Another object lies in the provision of means that would permit the portals of entry of the molding material to be located at a variety of areas of the footgear, said areas to be chosen mainly for ease of accessability.

Another feature of the invention lies in the fact that the inventive means may be employed in a wide variety of footgear ranging from sneakers, boots, fashionable dress shoes, orthopedic shoes, and the like, without requiring change of size of said footgear.

Another feature of the invention permits the use of injection apparatus presently, easily, and inexpensively available.

SUMMARY OF THE INVENTION

In accordance with the present invention pertinent areas of footgear are molded by multiple individual water and air tight elements, each of said elements comprising a flexible bag, a connecting part or tube, and an end port piece.

Said flexible bag receives and contains the molding material. Said port piece, which serves as portal for the molding material, has means to maintain closure while easily permitting selected injection or withdrawal of said molding material.

Said flexible bag and said port pieces are connected by a connecting part, said connecting part being a flexible tube of unique flat construction. Said unique construction is of such size and shape that passage or retention of molding material within said unique connecting part would not be readily apparent to a foot, or any part thereof, resting on said connecting part. Said connecting part may be an extension of said bag.

The size and shape of each of said flexible bags, and the shape of said connecting parts varies with its location within the footgear.

Said bags of said elements are located in the footgear corresponding with respect to the foot of the wearer to areas that would benefit for the pressure and support of said bags. Such areas are most commonly under and proximal to the second, third and fourth Metatarsal-Phalangeal joints, the area immediately distal to the dependent part of the heel bone medially, the area distal to the dependent part of the heel bone laterally, the posterior medio-lateral periphery of the heel, the tongue of the footgear, the medial and lateral sides of the footgear. Less common areas are under the first Metatarsal-Phalangeal joint areas and under the fourth and fifth Metatarsal-Phalangeal joint areas.

The numbers of individual elements employed in any footgear is governed by the type of footgear and the space available. For example, a ski boot may employ five separate elements along the sole, two elements on both sides of the upper and another element under the tongue of said boot. A ladies' dress shoe may employ only three separate elements along the sole, while a ladies' dress sandal may use only one element.

In a preferred embodiment of the invention, the end port pieces of said elements are secured in easily accessable position in the footgear. For example, said accessable positions may be along the inner (medial) sides of the sole, or along the lateral sides of the sole, or the front of the heel, etc.

In a modification of the invention, said end port pieces are not used. In said modification the end of the connecting part is closed by being manually folded on itself several times. Then said fold is tucked under the inner sock lining and adhered to the underlying sole of the footgear with adhesive tape.

The materials used for molding can be a fluid, such as water, or a gas such as air. An anti-freeze solution can be used in footgear used in cold climates. In some situations fluids containing finely divided solid material may be advantageous. Air can be used in footgear designed for sick, misshapen, or debilitated feet.

In the preferred embodiment, the molding fluid or gas is injected by use of a hypodermic syringe attached to a hollow needle, or the like. The needle penetrates the self closing port end piece and the molding material can be injected or withdrawn.

In the modification of the invention where there is no formal end piece, the syringe tip itself makes contact with the connection piece, in which case contact is maintained with finger pressure as necessary.

The process of molding is undertaken with the person seated, his feet in the footgear containing the invention. Molding material is injected into each of the elements in turn until the filled flexible bags are felt by the foot. Then the person stands and walks or runs, after which molding material can be added or subtracted from each element as seems necessary. Usually, just feeling a pleasant amount of support is the proper amount. Sometimes a pronounced positive pressure can be used in some areas to achieve a therapeutic correction of some orthopedic problems.

These objects and features, as well as other incidental ends and advantages will more fully appear in the progress of the following disclosure, and be pointed out in the appended claims. In the drawings to which reference will be made in the specification, similar characters have been employed to designate corresponding parts throughout the several views.

BRIEF DESCRIPTION OF THE DRAWINGS

FIG. 7. A cross section of a ladies dress shoe at line 7—7 of FIG. 8, showing a modifying addition to the connecting part of an element.

FIG. 8. A cross section of the ladies' dress shoe at line 8—8 of FIG. 7.

FIG. 10. Exploded view of the joining of a connecting part and port piece within the sole of the sports boot.

FIG. 11. Two schematic cut out areas of the sports boot sole, one empty, the other containing a joined connecting part and port piece.

FIG. 12. A cross section of a ladies' sandal with hypodermic syringe within the end of the connecting part of an element to illustrate a modification of the invention.

FIG. 13. Exploded view of the end of a connecting piece and a hypodermic syringe in a modification of the invention.

FIG. 14. Illustrates folded closure of connecting part secured by overriding tape in a modification of the invention.

FIG. 15. A plan view of the multi-pieced inner sole used over the various elements on the soles and sides of footgear.

DESCRIPTION OF THE PREFERRED EMBODIMENT

Figures 1, 2, 3:
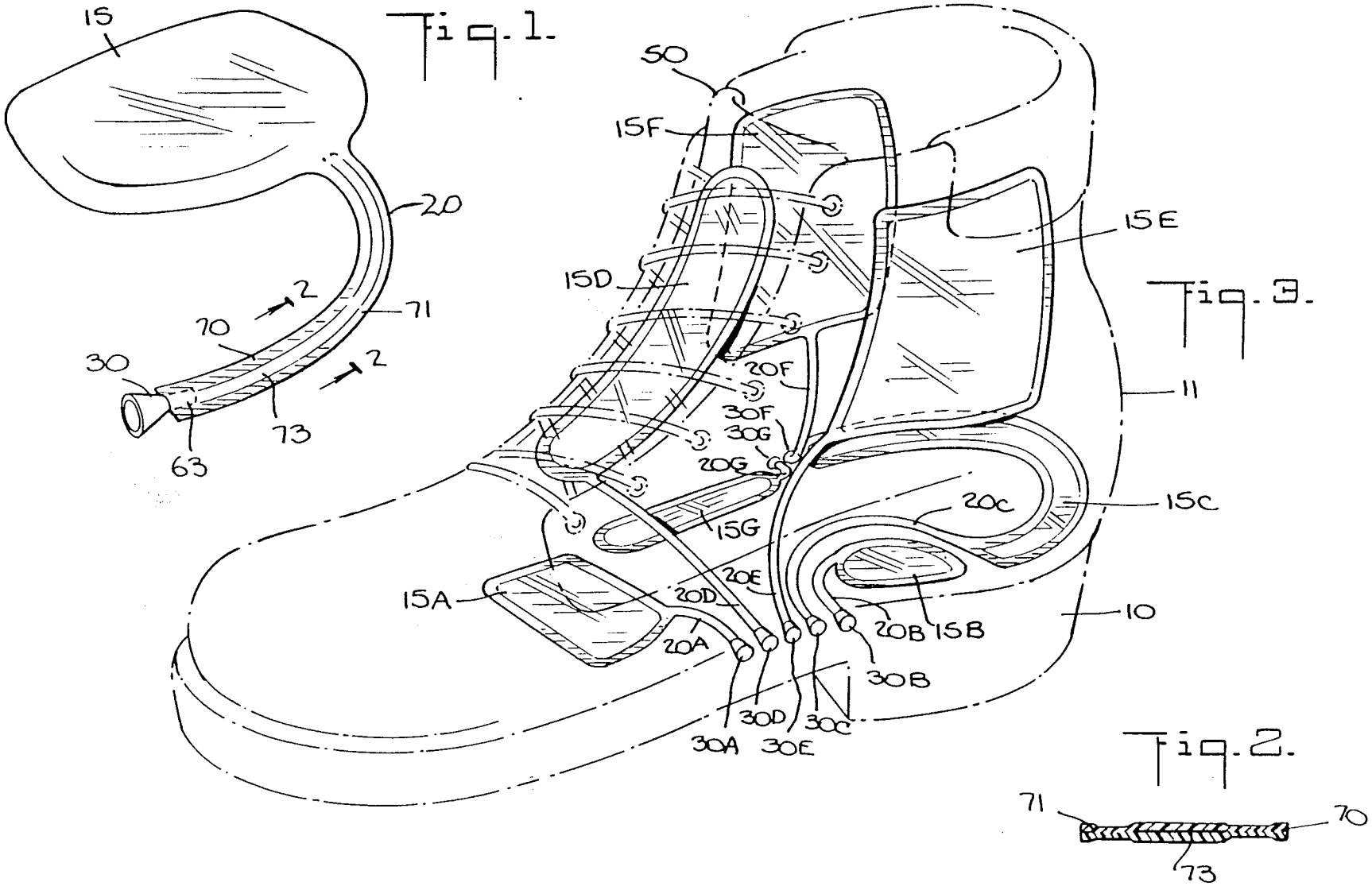
FIG. 1. A perspective view of one ccmplete element of the invention, illustrating the bag, the end port piece, and the connecting part between said bag and said port piece.
FIG. 2. Cross section of the connecting part.
FIG. 3. A phantom view in perspective of a sports boot, illustrating many complete elements in place on the sole and upper of said boot.

The invention comprises several individual complete impervious elements. FIG. 1 illustrates, schematically, an element with its component parts, said parts comprising a flexible bag 15, said bag 15 narrowing down to a flat connecting tube part 20, and said connecting part 20 joining a shaped rigid port piece 30. FIG. 2 illustrates a cross section of a connecting tube part 20. The shape and size of the flexible bag 15 varies in the various elements depending on its location in the footgear as illustrated in FIG. 3, FIG 4, FIG. 5, FIG. 6; 15A, 15B, 15C, 15D, 15E, 15F, 15G. The connecting flat tubular part 20 also varies in shape as illustrated in FIG. 3, FIG. 4, FIG. 5, FIG. 6; 20A, 20B, 20C, 20D, 20E, 20F, 20G. Said connecting part 20 is a flat flexible tube of unique construction and can be an extension of bag 15. Said unique construction of said connecting part 20 is such as to permit only enough expansion to allow for the free flow of molding material, where said expansion is relatively minimal so that when the said connecting tube part 20 is full of molding material it will not expand to the extent that such expansion would be felt by any part of the foot resting on it or against it. One way such minimal characteristics can be achieved is by having said connecting part 20 constructed of two flat pieces of flexible material, where said two pieces are joined on opposing sides FIG. 2, 70, 71, each joined side having a width of at least 3/32 of an inch along its entire length, and where the distance or open area between said opposing sides 70, 71 is about $\frac{1}{8}$ of an inch 73.

It is contemplated that the bags 15 and their connecting parts 20 will be of a flexible material permitting joining by heat sealing, or chemical welding, or some similar process, and where said flexible material can be a vinyl film, or the like.

Figures 4, 9:
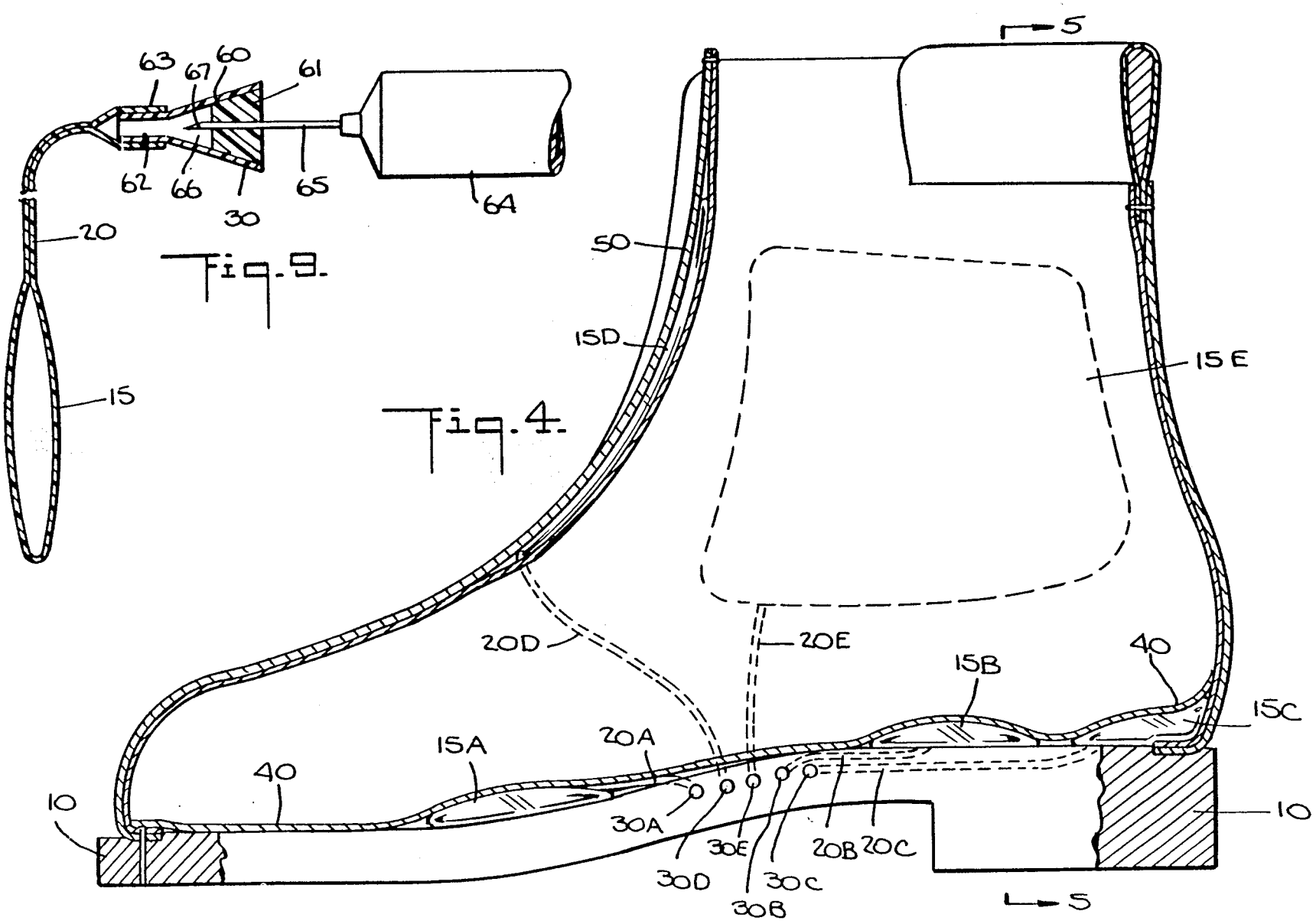
FIG. 4. A cross-sectional view of the sports boot at line 4—4 of FIG. 5, illustrating several elements in place.
FIG. 9. A schematic view of an element, showing the end port piece in place within the end of the connecting part, and a hypodermic needle in place within said port piece.

Referring to FIG. 9, the open end of the connecting part 20 flares 63 to accept the and piece 30. The end piece 30 comprises a narrowing cylindrical rigid piece 60 of which the narrowed end 62 fits into the flared part 63 of the connecting tube 20. The two parts, 20 and 30 are adhered by appropriate glues or welding material. The port end part 60 contains a latex or rubber-like stopper 61 which is secured to the interior of the wide end of the piece 60.

In accordance with the invention, FIG. 3 is a perspective view of a sports boot showing an outer sole 10, an upper 11 which contains tongue 50. In the metatarsal (ball of the foot) area of the bolt sole 10 is the bag 15A connected by tube 20A to the port piece 30A, said port piece 30A being set flush with the edge of the medial side of the sole 10. The bag 15D, secured in the inner side of tongue 50 is connected by tube 20D to the end piece 30D which is set flush with the medial side of sole 10. Bag 15E is secured to the medial inner side of upper 11 and said bag 15E is connected to the port piece 30E by connecting part 20E. Bag 15F is secured to the inner lateral side of the upper 11 and connected to port piece 30F by connecting part 20F.

Bag 15B, just distal to the area of the dependent part of the heel bone (not shown) is connected by tube part 20B to its end post piece 30B. Bag 15C (FIG. 3, FIG. 5) extends around the periphery of the medial, posterior and lateral part of the heel of the footgear, and is connected by tube part 20C to its post piece 30C.

Figure 5:
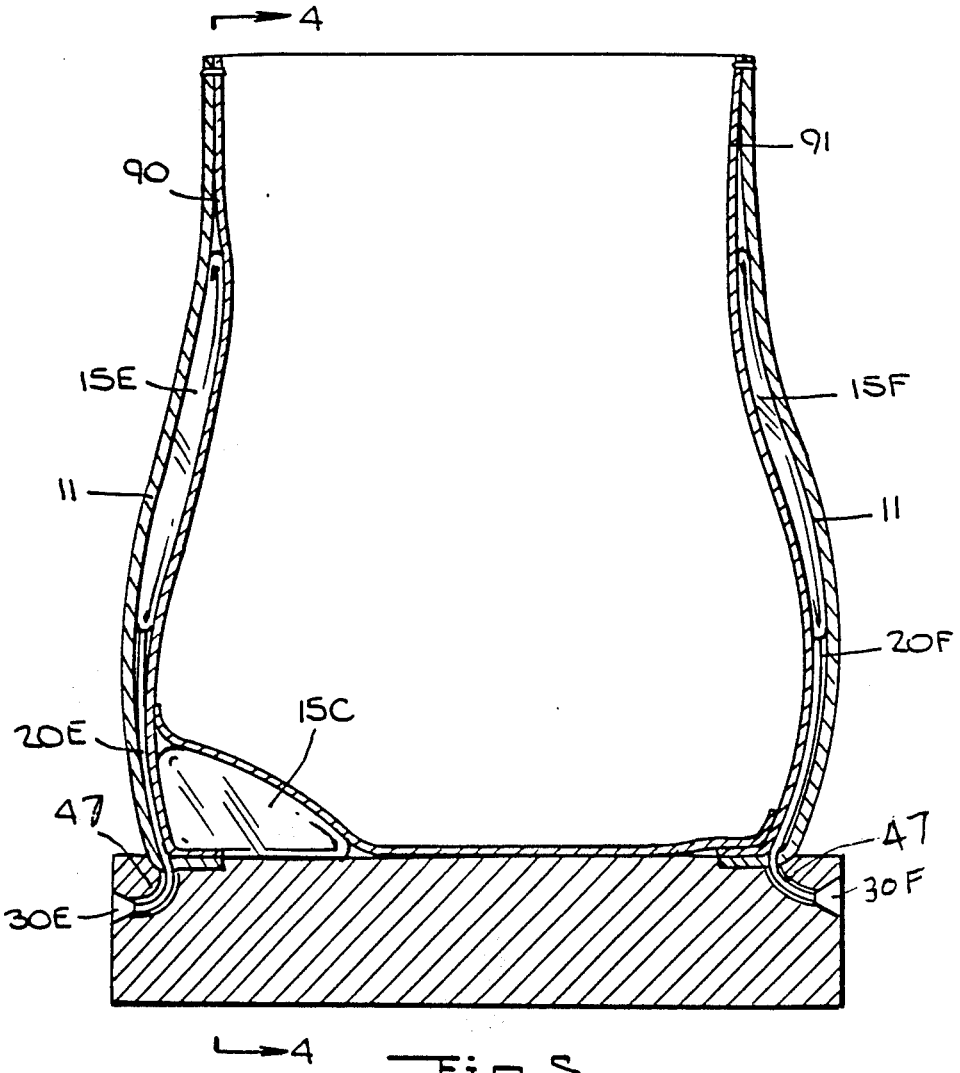
FIG. 5. A cross-sectional view of the sports boot at line 5—5 of FIG. 4, illustrating several elements in place.
Figure 6:
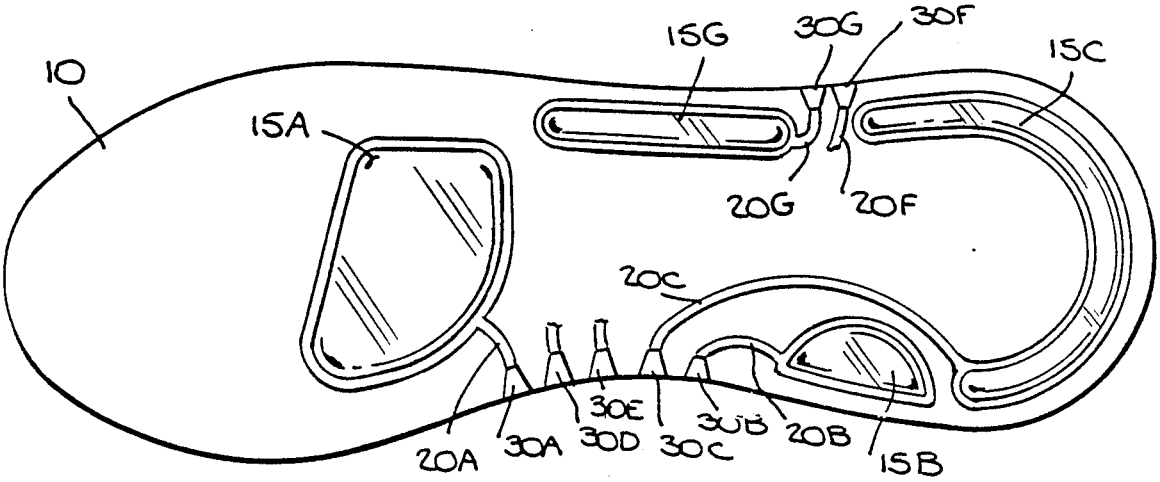
FIG. 6. A plan view of the sole of the sports boot, showing several complete elements in place, and some parts of other elements.

Referring to FIG. 6, the circular shape of the bag 15C is clearly seen. Said bag 15C can be divided into two parts, medial and lateral, each with its own connecting parts and end pieces (not shown). The bag 15G is seen at the lateral side of the sole 10, and is connected by part 20G to port piece 30G. The port piece 30F and part of its connecting tube part 20F is seen, but its bag 15F is not visible in this Figure. FIG. 5 shows the bag 15F and its connection by tube 20F to the port piece 30F, said part 20F passing through a cutout 47 at the edge of sole 10 to connect with port piece 30F. Bag 15E is seen connecting to port piece 30E via connecting port 20E, with said port 20E passing through cutout 47 of sole 10.

FIG. 10 illustrates an enlargement of the joining of said parts 20 to said parts 30.

FIG. 11 is a schematic detailed view of end piece 30 set into the cutout 47 where said piece 30 connects with the connecting part 20. The cutout 47A illustrates the cutout without said end piece 30.

FIG. 7 illustrates bags 15A, 15B, and 15C in a ladies' dress shoe, said shoe having a sole 13, upper 12 and heel 14. A cutout area 53 is shown in heel 14, said cutout area 53 being similar to cutout areas 45, 47, in FIG. 11, to receive end pieces 30. Where such a location requires a sharp turn of connecting part 20 that could interfere with the free flow of molding material, a shaped tube 28 is interspersed between port piece 30 and the connecting part 20. FIG. 8 illustrates location in anterior part of heel port pieces 30A, 30B and 30C.

It should be noted that for the invention to be placed in previously manufactured footgear, the only basic modification necessary in such previously manufactured footgear are the cutouts 47, FIGS. 5, 10 and 11. FIG. 7 also illustrates a unique inner liner 40, said liner 40 extending from toe to heel of shoe, where said unique construction of liner 40 permits conformity without wrinkling of said liner 40 to the varying individual shapes of said underlying bags 15A, 15B and 15C.

FIG. 15 is a plan view illustrating the three parts of said inner liner 40, said three parts comprising the center piece 44, and wing pieces 41, 42. The centerpiece 44 is of a figure eight configuration. The wings 41, 42 are generally elliptical in shape and are located on both sides of the narrow area of the part 44 and extend somewhat under said part 44, as illustrated by the dotted lines 58 and 54. The wings 41, 42 are attached to the center piece 44 at points 55, 56 by some simple means, such as a staple. The area 70 of the front part of said liner 40 and area 71 of the back part of said liner 40 are glued at their undersides for attachment to the sole 10.

In FIG. 7, the bag 15A is seen attached by glue means to the underside of liner 40 at area 72. In a similar way, the bag 15B is attached to the underside of the liner 40 at area 73, and the bag 15C is attached to the underside of liner 40 at area 74. In FIG. 8 the heel end of liner 40 is seen to bend upwards to meet the upper 12 of the shoe. This upward conformity is permitted by the action of slits 49A and 49B which are cut into the sole 40 to permit the edges of said slits to overlap. The back part 44 of the liner 40 is wider than the footgear in this area so that pressure to force the liner 40 into the footgear will also force it to conform to the shape of upper 12.

The component parts of the liner 40, 44, 42, 41 are semi-rigid to permit the foot to slide over it easily, as the liner 40 conforms to the shapes of said underlying molded bags, 15A, 15B, 15C.

Said unique construction of liner 40 is part of U.S. Pat. No. 3,903,621 awarded this inventor. Said inner liner 40 has been described in some detail as its conforming ability is important to the smooth working of this present invention.

FIG. 9 illustrates a hypodermic syringe 64, with its hollow needle 65 piercing through the stopper 61, with the open end 67 of said needle 65 within the open area 66. In this position molding fluids or gases can be injected or withdrawn through the connecting tube parts 20 to the bags 15.

The shaped piece 60 is of a rigid material to prevent the inadvertant injection outside the area 66 which could cause leakage of the molding materials.

There are self sealing port end pieces known in the art that can be used with this invention. Among said port pieces is the type of valve used in the ordinary automobile tires; another is a valve composed of several overlapping flexible pieces secured at the end of a rigid tube; another is rubber or rubber-like stopper used in medical vials, where said stopper is, under some pressure, secured in the opening of its container to permit repeated penetration by a syringe needle without losing its sealed effectiveness. This last one is preferred in this embodiment.

It is to be noted that the end of the connecting port 63 and the narrowed circular piece 60 of the part piece 30 can be adhered together within the cut-out space 47 (FIG. 10, FIG. 11) to facilitate the placing of the invention within previously manufactured footgear.

Be it further noted that the invention can be easily modified to give as much benefit of the invention as the various types of footgear will accomodate. Thus, a ski boot can receive all the elements as illustrated in FIG. 3, while a ladies' dress shoe, FIG. 7, can receive only three complete elements, while a sandal, FIG. 12, can be fitted with only one element, or part thereof.

A modification of an element is illustrated in FIG. 12, where said sandal comprises a basic sole 85, a heel 86, and straps 82, 83, 84 and 81 to keep said sandal on the foot. In said modification of an element, the port piece 30 is not attached. The flexible bag 15 and its connecting tubular part 20 ends at its shaped end part 63. Said end part 63 receives the tip 68 of the hypodermic syringe 64 as indicated in the exploded close up FIG. 13. Finger pressure (not shown) holds the shaped end part 63 in contact with the syringe tip 68 while molding material is added or subtracted. FIG. 14 illustrates closure of this modification, said closure being achieved by folding the end poriton of the connecting part 20 several times upon itself 80, and tucking said folded area under the inner sole 40 (not shown). The folded part 80 is secured to the sole 85 by adhesive tape 87, FIG. 14.

I wish it to be understood that I do not consider the invention limited to the precise details of structure shown and set forth in this specification for, obviously, modifications will occur to those skilled in the art to which this invention pertains.

I claim:

1. Apparatus for providing footgear with comfortable individualized molded support, said apparatus comprising a plurality of independent flexible impervious liquid proof bag structures for retaining a non-setting free flowing fluid; each bag structure having a conduit extending therefrom terminating in a port constructed to maintain closure of said element while permitting selective insertion or withdrawal of said non-setting fluids said bag structure being located in the footgear with respect to the foot of the wearer to provide individual areas of the foot with external pressure and support said bags and connecting parts being secured to an overriding innersole, said overriding innersole having means for adherence to the sole and upper of said footgear.

2. Apparatus as defined in claim 1, where said ports are securely embodied in said footgear.

3. Apparatus as defined in claims 1 and 2, where said ports are set flush with the outer surfaces of said footgear.

4. Apparatus as defined in claim 1, where said ports are of such configuration as to permit use in conjunction with hypodermic syringes and needles.

5. Apparatus as defined in claim 1, where said bag structures are selectively shaped to give individually supportive pressure, at least to such areas generally under the proximal to the second, third, fourth and fifth Metatarsel-Phalangeal joints, the area immediately distal and medial to the Clacaneal bone, the area distal and lateral to the Calcaneal bone, the posterior medio-lateral periphery of the heel, the tongue of the footgear, the medial and lateral sides of the footgear, the area under the First Metatarsal-Phalangeal joint.

6. Apparatus as defined in claim 1, where the connecting conduits comprise flexible tubes that folding a said conduit upon itself and adhering same to inner aspects of footgear will achieve closure of said conduits with retention of fluids within said elements.

7. Apparatus as defined in claim 1 wherein said free flowing non-setting fluid is selected from the group of liquids consisting of water, water solutions, oils, anti-freeze mixtures, fluids containing finely divided solid material.

* * * * *